United States Patent [19]

Shiba

[11] Patent Number: 4,898,379

[45] Date of Patent: Feb. 6, 1990

[54] CYCLE TRAINER HAVING A LOAD APPLYING DEVICE

[75] Inventor: Kenzo Shiba, Settsu, Japan

[73] Assignee: Tsuyama Mfg. Co., Ltd., Osaka, Japan

[21] Appl. No.: 286,619

[22] Filed: Dec. 19, 1988

[51] Int. Cl.[4] ..... A63B 21/00; A63B 21/24

[52] U.S. Cl. ..... 272/73; 272/129

[58] Field of Search ..... 272/73, 129; 211/20

[56] References Cited

U.S. PATENT DOCUMENTS

| | | | |
|---|---|---|---|
| 2,972,478 | 2/1961 | Raines | 272/73 |
| 3,125,341 | 3/1964 | Carrington | 272/73 |
| 4,441,705 | 4/1984 | Brown | 272/73 |
| 4,613,129 | 9/1986 | Schroeder et al. | 272/73 |
| 4,674,742 | 6/1987 | Baatz | 272/73 |
| 4,826,150 | 5/1989 | Minoura | 272/73 |

FOREIGN PATENT DOCUMENTS

| | | | |
|---|---|---|---|
| 2950605 | 6/1981 | Fed. Rep. of Germany | 272/73 |

*Primary Examiner*—Stephen R. Crow

*Attorney, Agent, or Firm*—Allegretti & Witcoff, Ltd.

[57] ABSTRACT

A roller 26 for applying a load to a tire 44 of a rear wheel as a drive wheel is rotatably supported by support frames 30 through a roller shaft 24. The support frames 30 are rotatable about a fixing shaft 28 penetrating their ends. A support portion 29 supporting the fixing shaft 28 is fixed to a load applying device stand 2 to be inserted in a rear frame 22. A coil spring 34 is provided between a fixing plate 32 fixed to the load applying device stand 2 and a transverse plate 31 of the support frames 30. A pedal clamp 38 to be engaged with the plate 31 in a state of the coil spring 34 being compressed is rotatably provided on the load applying device stand 2. When a load applying device is to be used, the position of the load applying device stand 2 is adjusted so that the roller 26 slightly contacts the rear wheel tire 44 with the pedal clamp 38 being engaged with the plate 31. Then, the pedal clamp 38 is disengaged therefrom and the roller 26 applies a predetermined contact force as a load to the rear wheel tire 44.

6 Claims, 16 Drawing Sheets

CYCLE TRAINER HAVING A LOAD APPLYING DEVICE

BACKGROUND OF THE INVENTION

1. Field of the Invention

The present invention relates to cycle trainers and particularly to a cycle trainer by which training can be done indoors, simulating real outdoor riding.

2. Description of the Background Art

There have been developed various cycle trainers used for cycle training in a room, simulating real outdoor running, in which a bicycle not having a front wheel is fixed and the rear wheel of the bicycle is rotatably in contact with a rotating roller to which load is applied.

FIG. 17 is a schematic side view of such a cycle trainer disclosed in U.S. Pat. No. 4,441,705, and FIG. 18 is a sectional view taken along the line XVIII—XVIII of FIG. 17.

Referring to those figures, the structure and functions of the cycle trainer will be described.

A bicycle from which the front wheel is removed is fixedly supported by a front frame 152 and a stay 156 by means of a front fork 16 and a bracket lug 154. The front frame 152 is connected to a support 150 which is a main body of the trainer, and a height adjusting portion 158 into which the stay 156 is inserted for adjustment of the height is attached to a central portion of the support 150. A stable setting member 151 in the form of a pipe perpendicular to the support 150, for stably setting the trainer is connected to an end of the support 150. A load applying device 1 on which a rear wheel 10 is mounted is attached to a portion of the support 150 near the stable setting member 151 through an adjusting bolt-nut set 164. The load applying device 1 comprises a roller 26 having a high friction coefficient to be in contact with a tire 44 of the rear wheel 10, a rotating shaft 162 inserted integrally in the roller 26 and rotatably supported by a support frame 30, a fan 50 attached to an end of the rotating shaft 162, and an inertial wheel adjuster 166 attached to the other end of the rotating shaft 162. The fan 50 is covered with a casing 51, which has an opening connected with an air tube 160 having a top end near a handle portion of the bicycle.

When the trainer is to be used, the height of the stay 156 is adjusted by the height adjusting portion 158 according to the size of the bicycle to be fixed and the bracket lug 154 is attached to the stay 156. Then, the adjusting bolt-nut set 164 is adjusted to move the support frame 30 forward or backward so that the tire 44 is in contact with the roller 26, and then the load applying device 1 is fixed by fastening the adjusting bolt-nut set 164. After the adjustment and fixation of the bicycle, the user rides on the bicycle and practices cycle training by means of pedals 14 in the same manner as in real riding of a bicycle. The pedal movement rotates the rear wheel 10 and rotates the roller 26 through the tire 44. The rotation of the roller 26 rotates simultaneously the fan 50 and the inertial wheel adjuster 166 through the rotating shaft 162. The inertial wheel adjuster 166 serves to apply a riding resistance in real riding to the user and the inertial wheel can be replaced at any time with other inertial wheel of a different size or weight. The fan 50 serves to apply an air resistance in real riding to the user and it gives a resistance to the rotating shaft 162 according to rotation of the roller 26, that is, a real riding speed. A quantity of air generated by the rotation of the fan 50 is made to blow from the front side to the user of the trainer through the air tube 160 so as to produce an effect as if in outdoor riding of a bicycle.

In the above described conventional cycle trainer, it is difficult to precisely simulate a real riding resistance.

More specifically, although the inertial wheel adjuster 166 and the fan 50 are provided to simulate the riding resistance and the air resistance in real riding of a bicycle, those devices exhibit their functions only on the basis of accurate contact between the tire 44 and the roller 26. However, the adjustment of the contact depends on adjustment by using the height adjusting portion 158 and the adjusting bolt-nut set 164 and therefore accurate adjustment of contact force cannot be expected. Thus, the resistance applied to the rotating shaft 162 by means of the inertial wheel adjuster 166 and the fan 50 cannot be accurately transmitted to the crank of the pedals 14 through the roller 26 under the tire 44 and accurate stable workload cannot be given to the user in a satisfactory manner.

SUMMARY OF THE INVENTION

An object of the present invention is to provide a useful cycle trainer.

Another object of the present invention is to provide a cycle trainer capable of accurately simulating real riding of a bicycle.

A further object of the present invention is to provide a cycle trainer which is capable of accurately simulating power based on a rolling resistance in real riding.

In order to accomplish the above described objects, a cycle trainer according to the present invention comprises: a rotatable roller; energizing means for constantly energizing the roller in a direction of contact with a drive wheel; movement blocking means to be engaged with the energizing means, for blocking movement of the roller toward the direction of the drive wheel; position adjusting means for adjusting the roller at a predetermined position with respect to the drive wheel while the movement of the roller is blocked by the movement blocking means; and disengaging means for disengaging the movement blocking means from the energizing means, the disengaging means being enabled to release the movement blocking means from the energizing means so that the roller is rotatably in contact with the drive wheel.

In the cycle trainer thus structured, the roller is brought into contact with the drive wheel by the energizing means after it has been adjusted at the predetermined position with respect to the drive wheel and accordingly it is possible to assure a constantly accurate contact force between the drive wheel and the roller.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

First, the concept and the theory of a cycle trainer according to the present invention will be described and then structure and operation of an embodiment of the present invention will be described.

In the cycle trainer according to the present invention, a load which accurately simulates a riding resistance on a flat ground or a climbing resistance on a slope based on a rolling resistance and an air resistance in real riding is applied to a drive wheel of a bicycle attached to the cycle trainer so that the user can practice training indoors corresponding to that in real riding of a bicycle.

In general, a total riding resistance (R) of a bicycle in real riding is expressed as follows.

$R = Rr + Ra + Rs$

Rr: rolling resistance

Ra: air resistance

Rs: climbing resistance on slope

Practically, an acceleration resistance is further added but it is difficult to approximate a resistance for increasing inertia energy based on speed changes of the acceleration.

The rolling resistance (Rr) is a resistance on a contact face between the bicycle and the ground and it is expressed as follows:

$Rr = W \times \mu$(kgf)

W: weight of user + weight of bicycle (kgf)

$\mu$: rolling resistance coefficient of tire

The air resistance (Ra) is a resistance caused by air with respect to the user and the bicycle at the time of riding and it is expressed as follows:

$Ra = Cd \times A \times \rho v^2/2$ (kgf)

Cd: resistance coefficient

A: forward projected area of user and bicycle ($m^2$)

$\rho$: air density ($0.125 kg.\cdot^{-4}\cdot S^2$)

v: riding speed ($v\cdot s^{-1}$)

Consequently, power P against riding resistance on a flat ground is expressed as follows:

$Pl = (Rr + Ra) \times g \times v$ (watt)

g: gravitational acceleration speed ($9\cdot 8 m.S^{-2}$)

Figure 13:
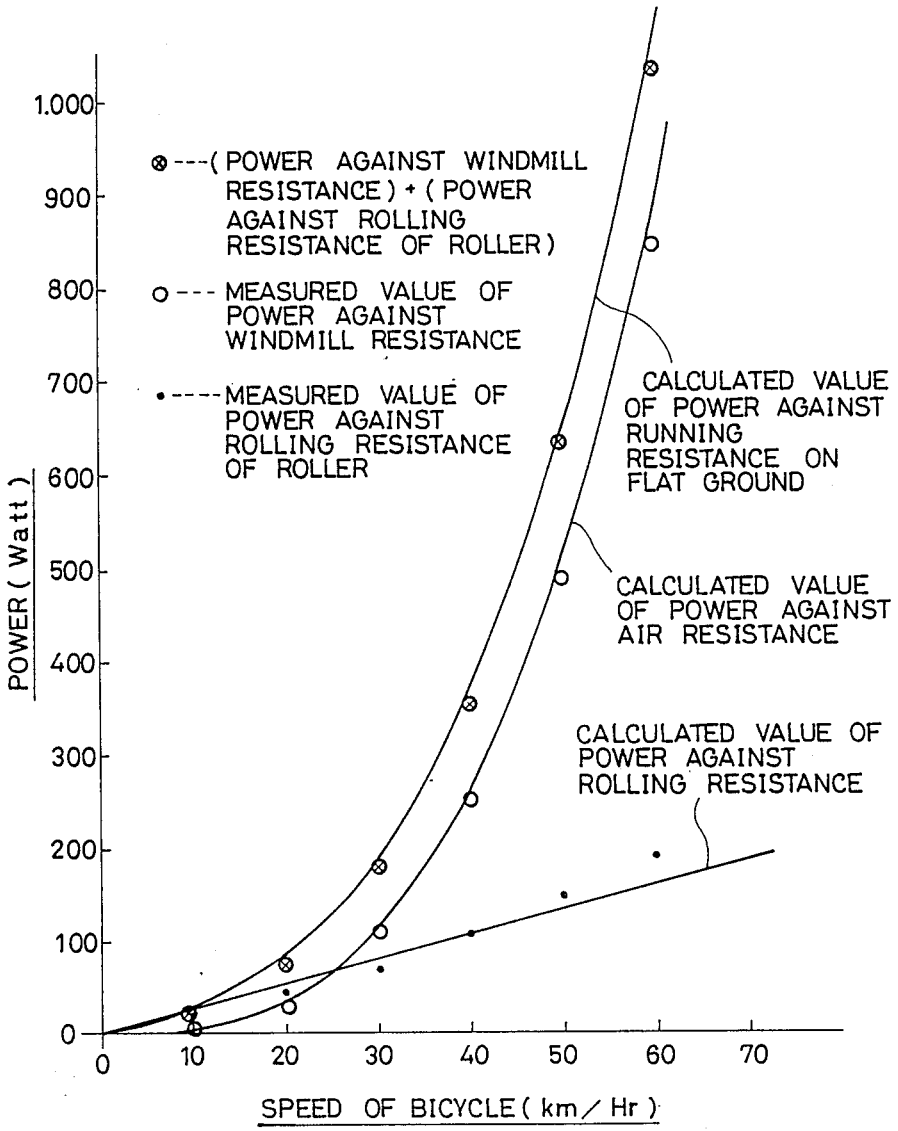
FIG. 13 is a graph showing a relation between power and running speed in the cycle trainer according to the embodiment.

FIG. 13 is a graph showing a relation between the power P and a riding speed v. In this graph, the solid lines represent values of power against rolling resistance, power against air resistance and power against riding resistance on a flat ground, calculated by the above indicated equation on the assumptions as follows: a rolling resistance coefficient on a flat ground is $\mu = 0.012$; the total weight as an average value of a general sports type bicycle and a user is $W = 81\cdot 6$kgf. (180 bf); a projected area in a forward inclined posture is $A = 0.36 m^2$; and an air resistance coefficient in this posture is $Cd = 0.88$.

The dots ● represent measured values of the power based on rolling resistance of a roller; the dots o represent measured values of the power based on wind resistance; and the dots ⊗ represent values obtained by addition of the measured values of the power based on windwill resistance to the measured values of the power based on rolling resistance.

The total resistance (R) in running on a slope is expressed as follows:

$R = Rr + Ra$

Rr+Ra: riding resistance on flat ground

Rs: climbing resistance $Rs = W \times \sin\theta$(kgf)

$\theta$: angle of gradient of slope

Therefore, power Ps in opposition to the climbing resistance is as follows:

$Ps = Rs \times g \times v$ (watt)

Figure 14:
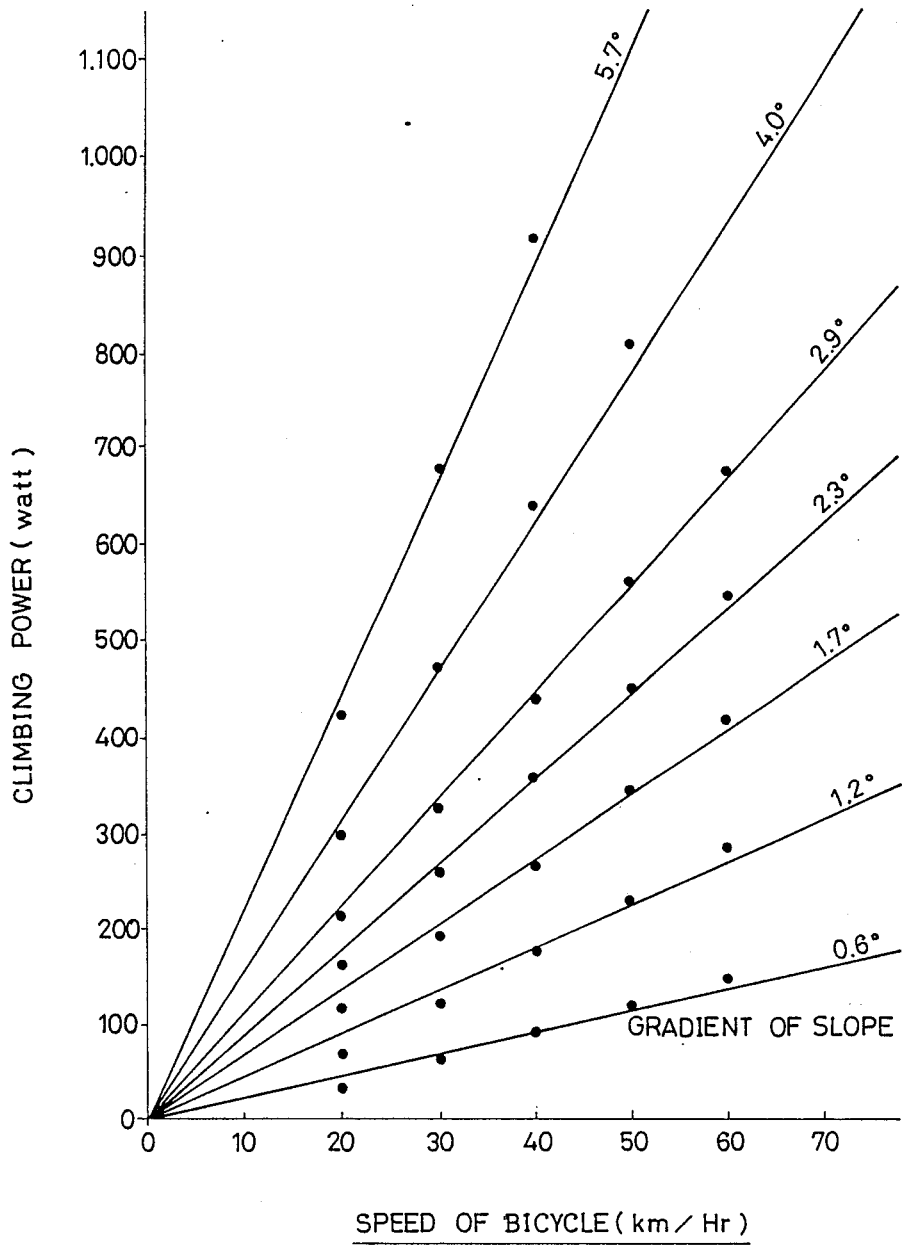
FIG. 14 is a graph showing relations between power and riding speed for specified slope gradients in the cycle trainer according to the embodiment.

FIG. 14 is a graph showing a relation between the power Ps and the riding speed v of the bicycle for each specified gradient. In this graph, the solid lines represent calculated values of power in opposition to climbing resistance with $W = 81.6$ kgf. for the respective gradient angles.

The dots ● represent measured values which simulate the power for the respective gradient angles by changing a magnet position to simulate the above indicated calculated values.

Each of the measured values thus represented is a value obtained by subtraction of the power in opposition to rolling resistance of the roller from the power in opposition to rotating resistance of the roller under action of the magnet.

Accordingly, total power Pa in running on a slope is expressed as follows:

$Pa = (Rr + Ra + Rs) \times g \times v$ (watt)

In order to accurately simulate the total riding resistance in real riding as described above, the cycle trainer according to the present invention is constructed in the following manner. Rolling resistance is given by a rotating roller in contact with a rear wheel. Air resistance is given by a first load applying device, that is, a fan attached to one end of the shaft of the rotating roller and climbing resistance is given by a second load applying device provided on the other end of the roller shaft, that is, a disc-shaped conductor as an eddy current load applying device and a magnet located to face opposite surfaces of the conductor. The fan has a shape which makes it possible for power based on a torque value transmitted from the rear wheel to a crank shaft by rotation of the rear wheel in contact with the roller to attain the measured value shown in FIG. 13, equal to a calculated value. In addition, control of a flux amount caused by the magnet and applied to the conductor makes it possible for power measured in the same manner to be equal to a calculated value simulated as shown in FIG. 14, corresponding to a slope gradient.

Further, in order to calculate a corresponding speed in real riding of a bicycle, it is necessary to take account of slip caused between the rear wheel and the roller.

Figure 15:
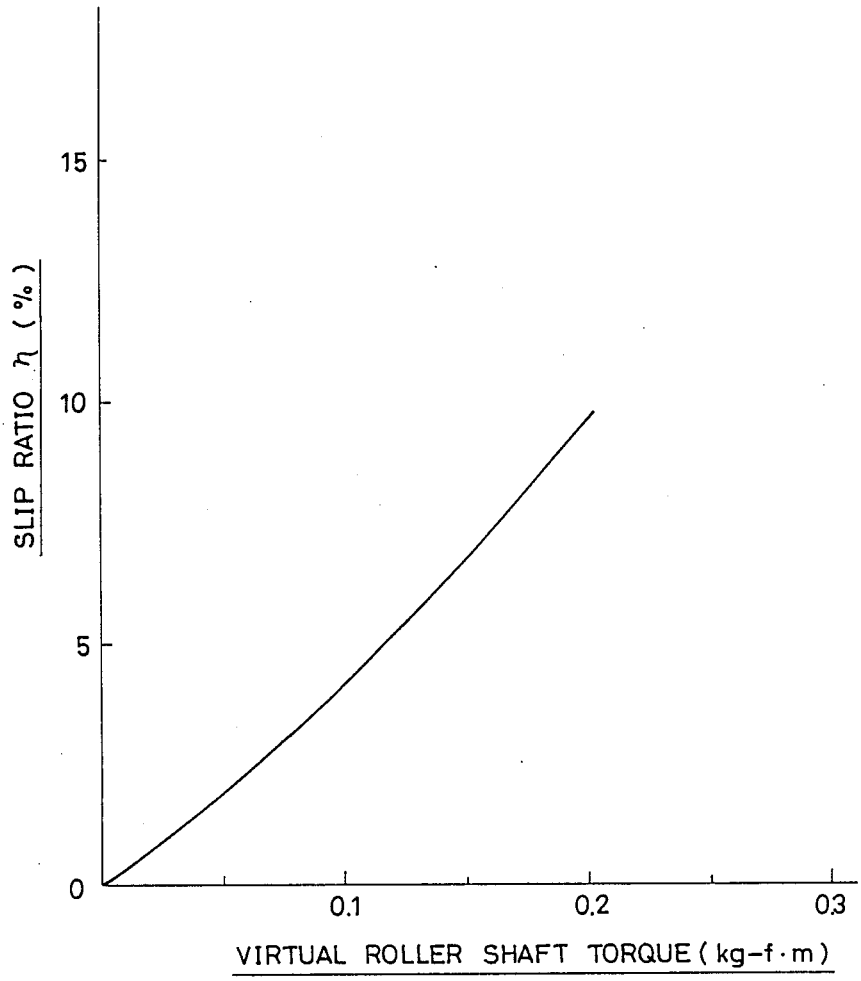
FIG. 15 is a graph showing a relation between a slip ratio and a virtual roller shaft torque in the cycle trainer according to the embodiment.

FIG. 15 is a graph showing a relation between the slip ratio and virtual roller shaft torque.

In this graph, the virtual roller shaft torque (TQ) is calculated by the following equation.

TQ=crank shaft torque x number of revolutions of crank shaft/number of revolutions of roller shaft.

Enforced force N applied to the roller in this case is 24 kgf.

Since the rolling resistance is given by the rotating roller in contact with the rear wheel as described above, it is important to determine the enforced force applied to the roller, namely, pressing force applied to the tire for accurate simulation of the resistance as well as other resistance.

Figure 16:
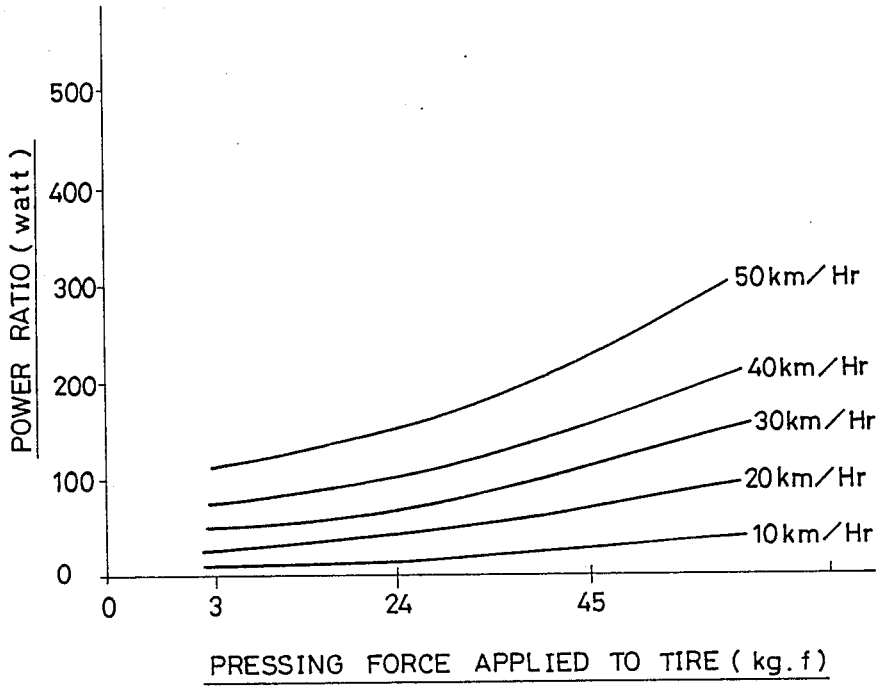
FIG. 16 is a graph showing a relation between a pressing force applied to a tire and power against rolling resistance of the roller and the tire in the cycle trainer according to the embodiment.
Figure 17:
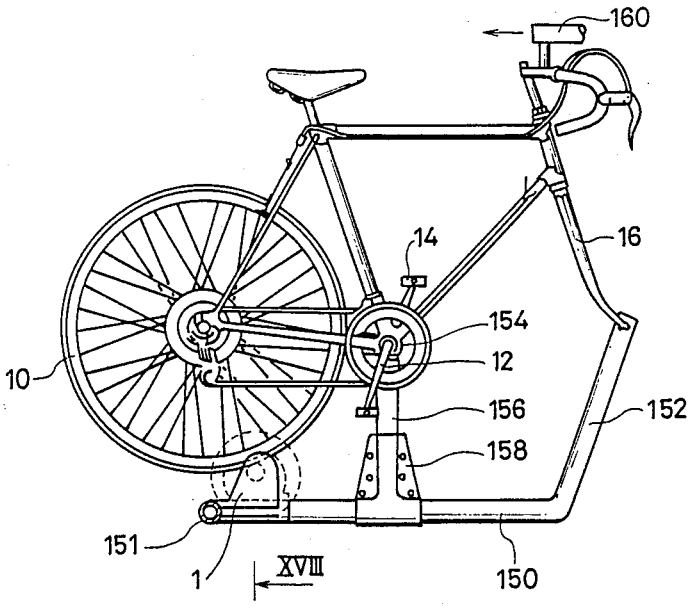
FIG.17 PRIOR ART
FIG. 17 is a schematic side view of a conventional cycle trainer.
Figure 18:
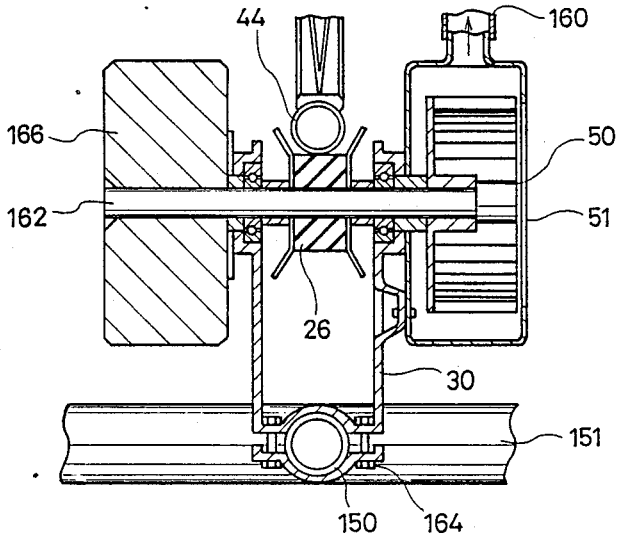
FIG.18 PRIOR ART
FIG. 18 is a sectional view taken along the line XVIII—XVIII in FIG. 17.

FIG. 16 is a graph showing the pressing force applied to the tire and power in opposition to roller resistance between the roller and the tire, in which air pressure of the tire is 6 atm.

In this graph, the abscissa represents pressing force applied to the tire and the ordinate represents power, whereby correlation for each specified speed of the bicycle is shown. The pressing force applied to the tire in this trainer is set to 24 kgf. so that power against the rolling resistance in real riding shown in FIG. 13 is given by the rotating roller. Accordingly, although the rolling resistance is expected to differ dependent on the condition of the ground surface, it is always possible to simulate power with an equal value by setting the pressing force of the roller to the tire constantly to a predetermined value, assuming the power to be based on a predetermined rolling resistance in real riding.

Now, the structure of an embodiment of the present invention will be specifically described.

Figure 1:
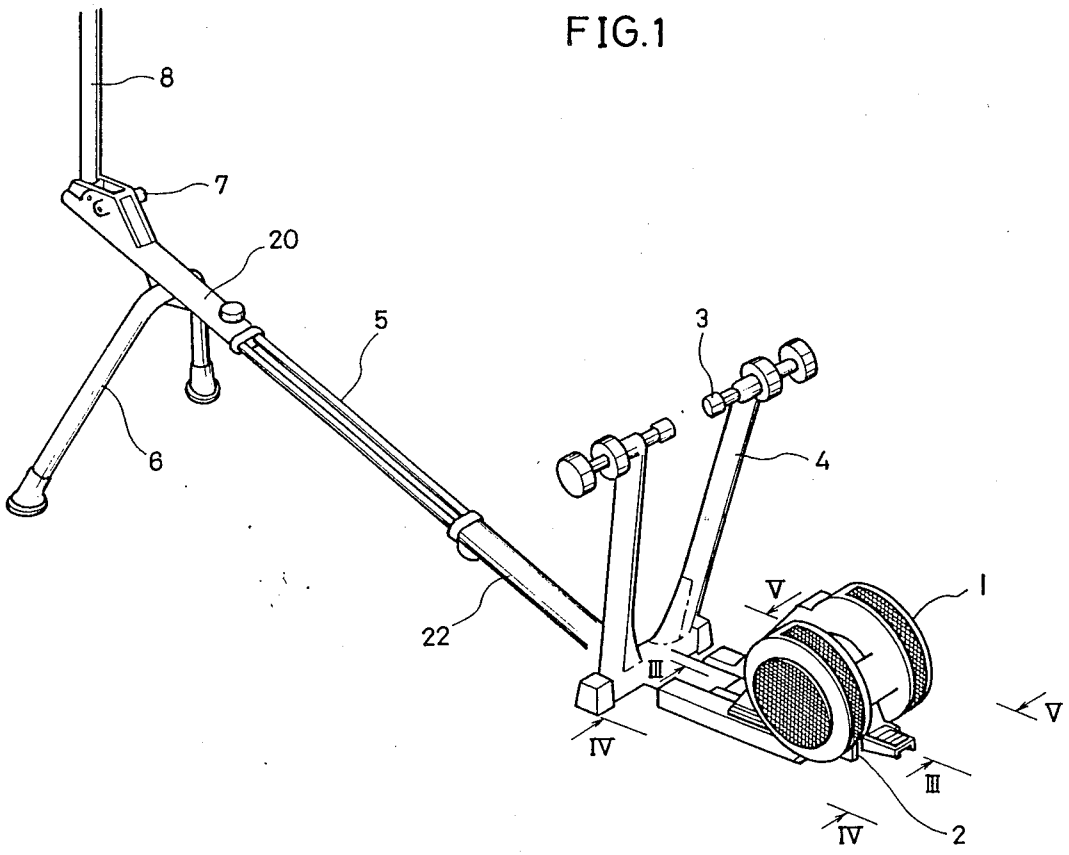
FIG. 1 is a perspective appearance view of a main body of a cycle trainer according to an embodiment of the present invention.
Figure 2:
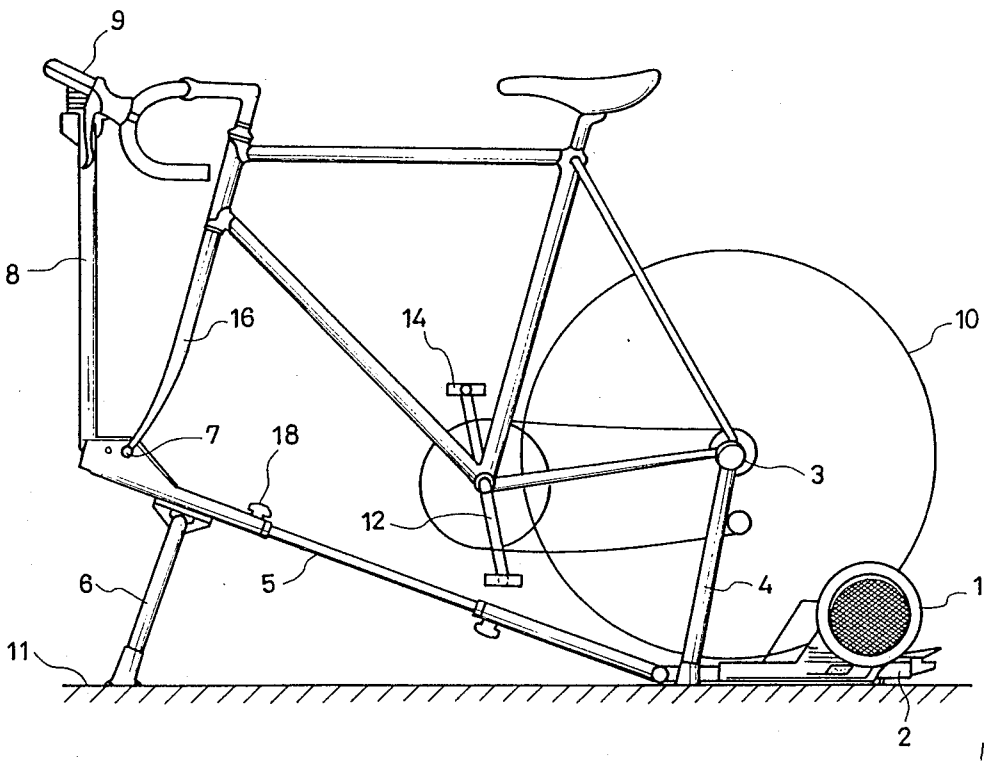
FIG. 2 is a schematic side view of the cycle trainer of FIG. 1 on which a bicycle is mounted.

FIG. 1 is a perspective appearance view of a main body of a cycle trainer according to the embodiment and FIG. 2 is a schematic side view in which a bicycle is mounted on the cycle trainer.

Referring to those figures, a front frame 20 and a rear frame 22 are connected through a wheel base adjusting pipe 5 for adjustment according to the length of a wheel base of a bicycle by means of adjusting screws 18. A front stand 6 for stably setting the cycle trainer is attached to the front frame 20 and this stand 6 is placed on a floor 11. Further, a front fork fixing holder 7 for fixing a front fork 16 of the bicycle and a display support 8 for fixing a display 9 are attached to the front frame 20. On the other hand, a rear stand 4 having at its top end a rear wheel hub axle fixing holder 3 for fixing a hub axle of the rear wheel 10 is attached to the rear frame 22. A load applying device 1 on which the rear wheel 10 is placed is connected to an end portion of the rear frame 22 through a load applying device stand 2. By using the cycle trainer thus structured, the user can practice training indoors, simulating real riding, by rotating the rear wheel 10 through a crank arm 12 using pedals 14.

Figure 3A:
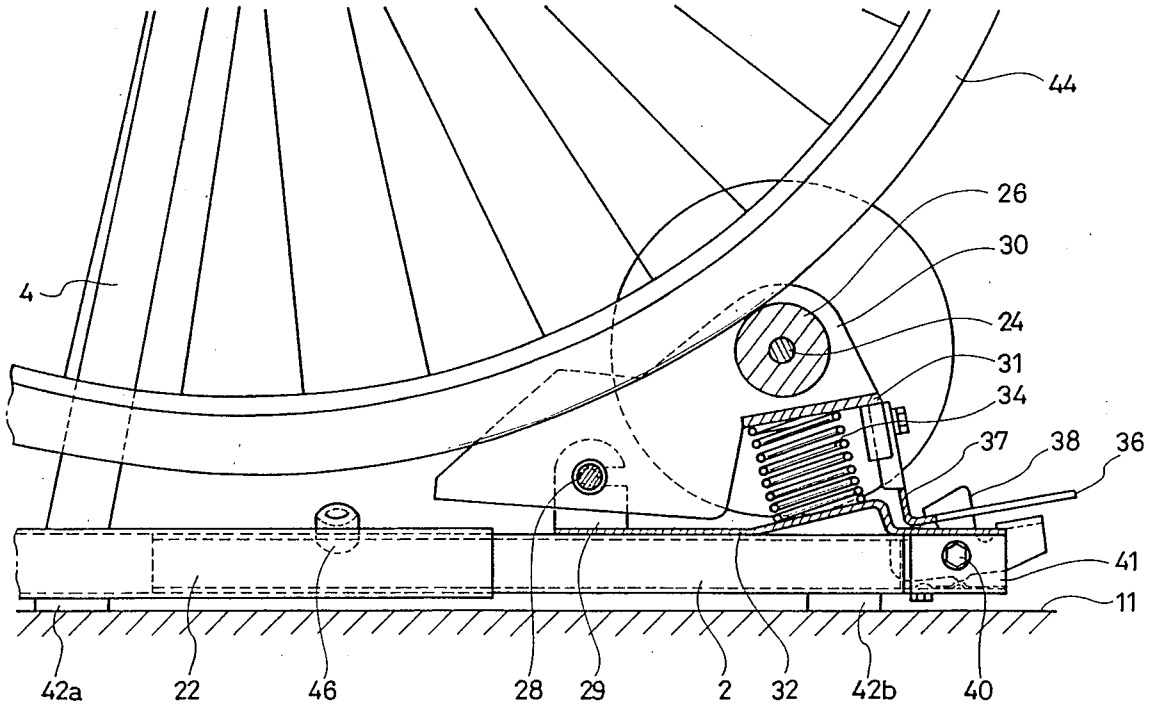
FIGS. 3A and 3B are sectional views taken along the line III—III in FIG. 1.
Figure 3B:
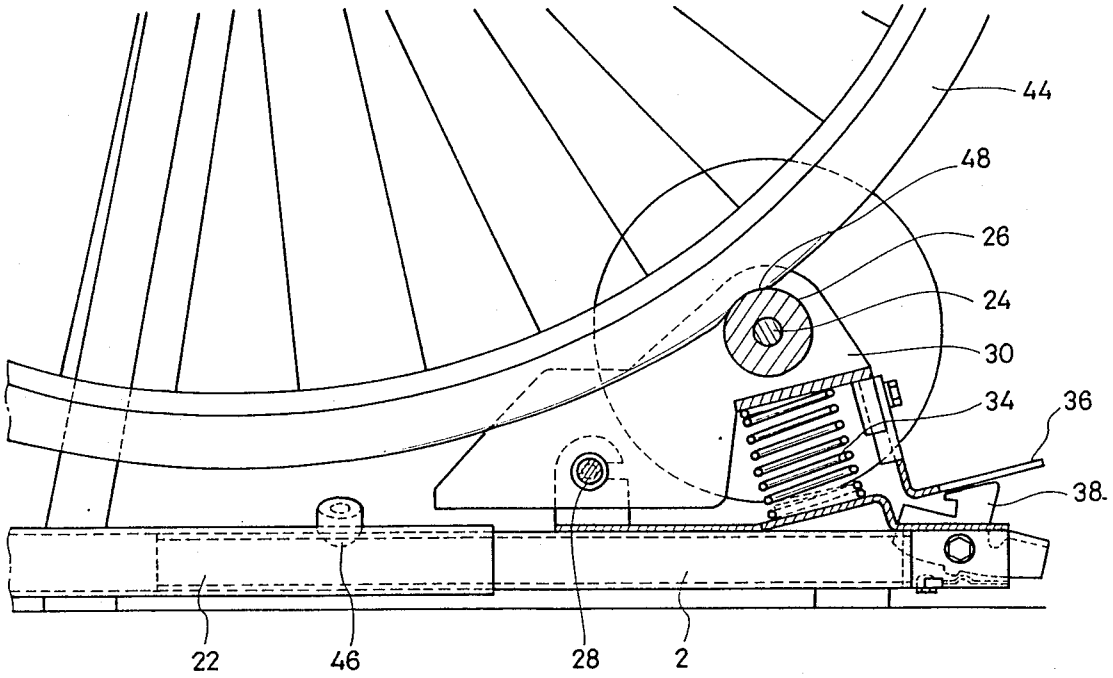

FIGS. 3A and 3B are sectional views taken along the line III—III in FIG. 1, in which a bicycle is mounted. FIG. 3A shows a state before the roller presses the tire of the rear wheel, and FIG. 3B shows a state after the roller presses the tire.

The structure shown in those figures will be described in the following.

The load applying device stand 2 has a shape freely inserted in the rear frame 22 and an adjusting bolt boss 46 for fixing the load applying device stand 2 at an arbitrary inserted position is attached to the rear frame 2. Spacers 42*a* and 42*b* for stable contact with the floor 11 are inserted in the rear frame 22 and the load applying device stand 2, respectively. A fixing plate 32 to which a coil spring 34 is attached is provided on the load applying device stand 2. A support portion 29 for rotatably supporting a fixing shaft 28 is attached to one end of the plate 32 and a support portion 41 for rotatably supporting a fixing shaft 40 is attached to the other end thereof. A roller shaft 24 integrally formed with the roller 26 in contact with a rear wheel tire 44 is supported rotatably on a pair of support frames 30 provided on both sides of the rear wheel tire 44. The pair of support frames 30 are rotatable around the fixing shaft 28 and the coil spring 34 contacts a lower surface of a transverse plate 31 which connects the pair of support frames 30. An engaging portion 37 fixed to the plate 31 and having an end connected to a pedal 36 engages with a pedal clamp 38 rotatable about the fixing shaft 40.

Referring now to FIGS. 1 to 3A and 3B, mounting operation for a bicycle and adjusting operation for the load applying device will be described.

First, the adjusting screws 18 are loosened according to the length of the wheel base of the bicycle so that the length of the wheel base adjusting pipe 5 is adjusted. Then the adjusting screws 18 are tightened and the front fork 16 and the rear wheel hub of the bicycle are fixed by means of the front fork fixing holder 7 and the rear wheel hub shaft fixing holder 3. After the bicycle has been mounted, the bolt applied to the adjusting bolt boss 46 is loosened to enable the load applying device stand 2 to be movable with respect to the rear frame 22, in a state in which the coil spring 34 is compressed, that is, in a state in which a hook portion of the pedal clamp 38 is engaged with the engaging portion 37 as a result of depressing the pedal 36. Then, the roller shaft 24 is moved together with the load applying device stand 2 toward a direction of contact with the rear wheel tire 44 and the roller shaft 24 is set at a position in which the roller 26 contacts the rear wheel tire 44. In this position, the adjusting screw of the adjusting bolt boss 46 is tightened so that the load applying device stand 2 is fixed to the rear frame 22. After that, when the pedal clamp 38 is disengaged from the engaging portion 37 by using the pedal clamp 38, elastic force of the compressed coil spring 34 energizes the plate 31, so that the roller 26 presses the rear wheel tire 44 through the support frames 30 and the roller shaft 24.

This state is shown in FIG. 3B, in which the elastic force of the coil spring is set to cause the depression of the rear wheel tire 44 in the pressing portion 48 due to the contact with the roller 26 to be 6mm., that is, to cause the pressing force applied to the tire to be 24 kgf.

Figure 4:
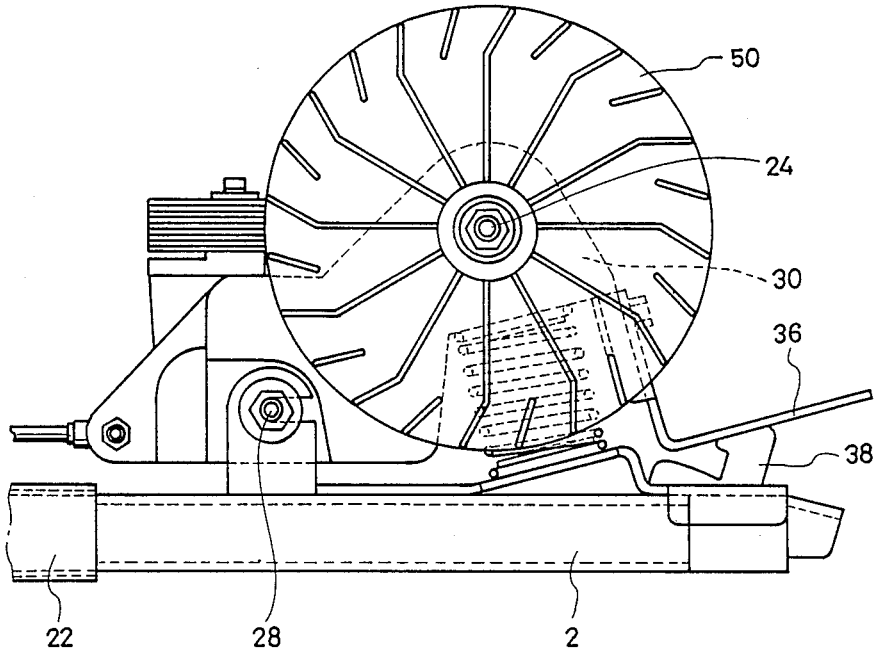
FIG. 4 is a side view taken from the side IV—IV in FIG. 1.

FIG. 4 is a side view of the load applying device taken from the side IV—IV in FIG. 1, in which a cover is removed form the device.

In FIG. 4, a fan 50 is provided on an end of the roller shaft 24 and it has a shape corresponding to power in opposition to air resistance as described previously.

Figure 5:
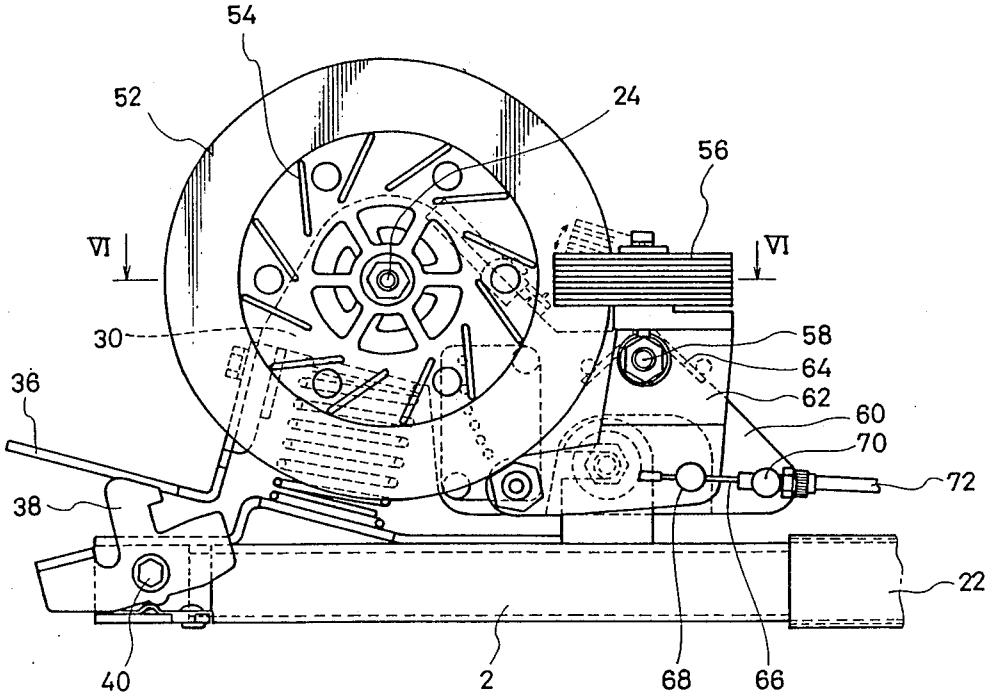
FIG. 5 is a side view taken from the side V—V in FIG. 1.
Figure 6:
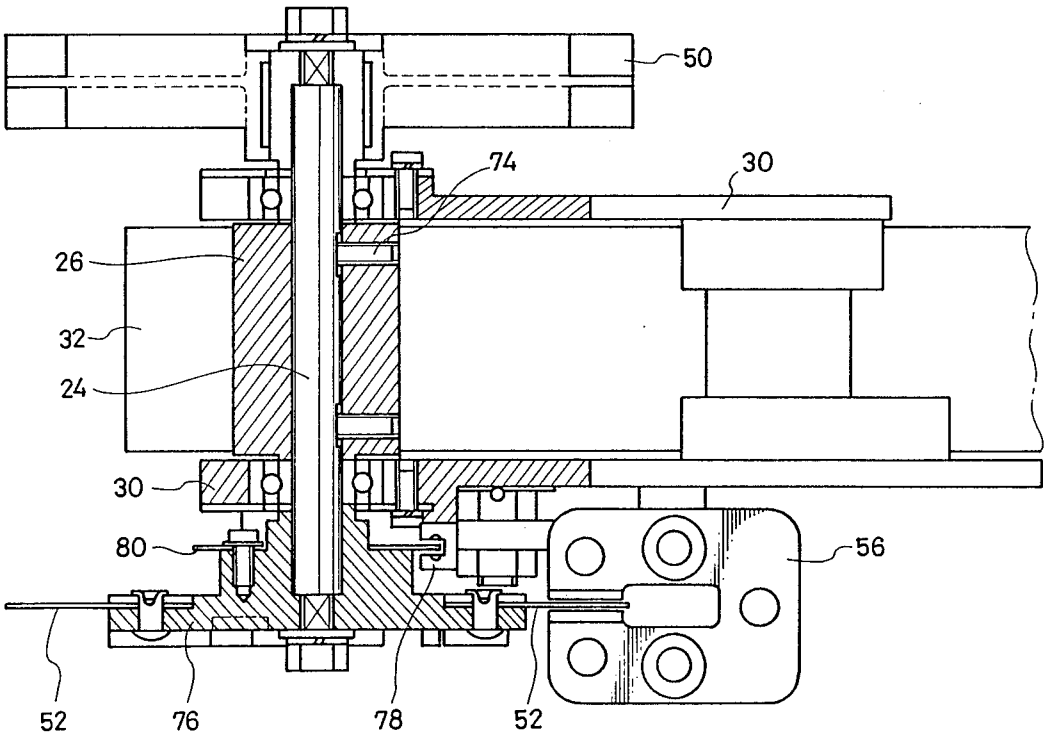
FIG. 6 is a sectional view taken along the line VI—VI in FIG. 5.

FIG. 5 is a side view of the load applying device taken from the side V—V in FIG. 1, in which the cover is also removed from the device. FIG. 6 is a sectional view taken along the line VI—VI in FIG. 5.

Referring to those figures, a copper disc 52 is provided on an end opposite to the end on which the fan 50 of the roller shaft 24 is provided, through a copper disc fixing hub 76 where cooling fins 54 are formed. A permanent magnet 56 of a depressed form where part of the disc 52 is interposed is attached to a fixing plate 62. The plate 62 is rotatable about a shaft 58 to which a torsion coil spring 64 is attached. On the other hand, a wire 66 introduced through a wire tube 72 is slidably inserted in a set screw 70 fixed to a support frame 60 and a top end of the wire 66 is fixed by a set screw 68 fixed to the plate 62. The wire tube 72 together with the wire 66 extends to a load selector (to be described later) provided near the display 9 shown in FIG. 2, where the wire 66 is pulled or pushed back so that the movement of the wire 66 is transmitted to the top end of the wire 66. The plate 62 is rotated around the shaft 58 through the set screw 68 so that the permanent magnet 56 moves from the position shown by the broken lines to the position shown by the solid lines. Since the permanent magnet 56 constantly generates a magnetic field in a direction penetrating the copper disc 52, eddy current is generated in the copper disc 52. This eddy current acts as a force for blocking rotating movement of the copper disc 52 and therefore the blocking force, namely, rotation resistance can be changed by change of the position of the permanent magnet 56. The area of the magnetic field caused by the permanent magnet, namely, an area of overlap with the copper disc is set so that the rotation resistance corresponds to the above described climbing resistance.

Further, a slitted disc 80 is attached to the copper disc fixing hub 76 on the side of the roller 26 and a pulse generator 78 is fixed to the support frames 30, facing opposite surfaces of the slit disc 80. Since the roller 26 rotates together with the roller shaft 24 by means of a bolt in a roller fixing screw hole 74, the rotation of the roller 26 gives rise to simultaneous rotation of the slitted disc 80 through the roller shaft 24 and the copper disc fixing hub 76.

Figure 8:
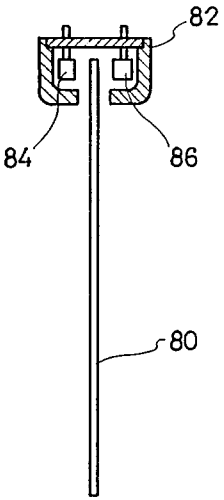
FIG. 8 is a sectional view taken along the line VIII—VIII in FIG. 7.
Figure 7:
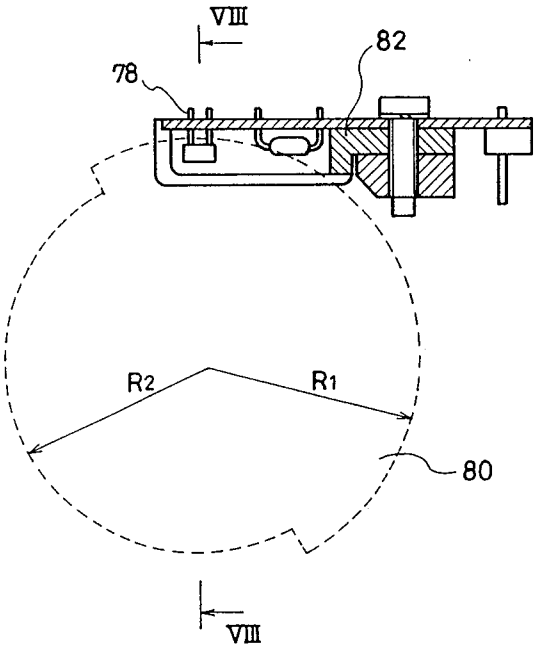
FIG. 7 is a schematic sectional view of a pulse generator and a slitted disc shown in FIG. 6.

FIG. 7 is a schematic sectional view specifically showing the above mentioned pulse generator and slit disc, and FIG. 8 is a sectional view taken along the line VIII—VIII in FIG. 7.

Referring to these figures, the slit disc 80 is a disc having two different radii R1 and R2, and the pulse generator comprises a light emitting diode 86 and a phototransistor 84 which are located to face only an external peripheral portion of the larger radius R1 and contained in a sensor case 82. Accordingly, each time the slit disc 80 makes a revolution, reception and interception of light in the phototransistor 84 with respect to light emitted from the light emitting diode 86 are effected alternately once. Consequently, the revolution of the slit disc 80, namely, the revolution of the roller 26 can be detected based on a light reception signal of the phototransistor 84.

Figure 9:
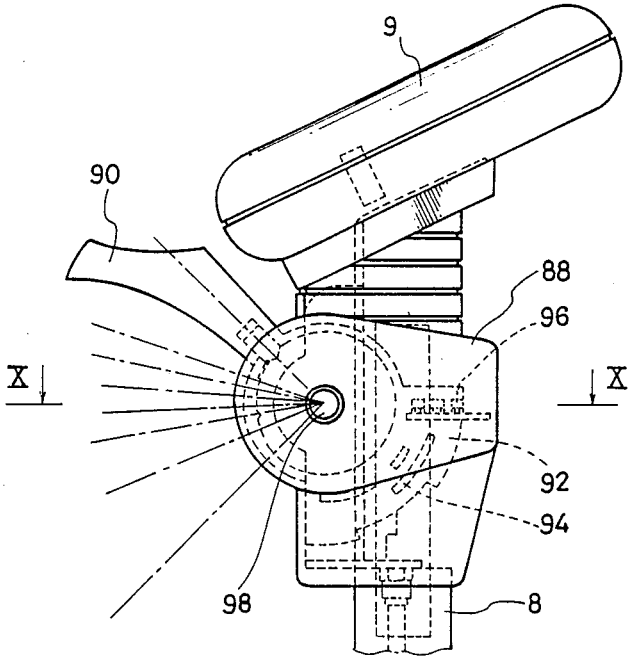
FIG. 9 is side view of a display device and a load selector in FIG. 2.
Figure 10:
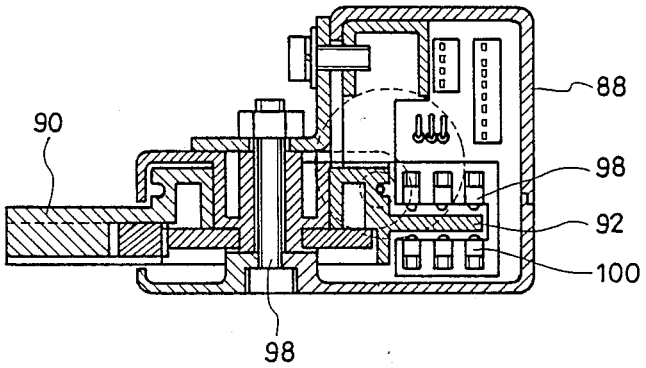
FIG. 10 is a sectional view taken along the line X—X in FIG. 9.

FIG. 9 is a side view of a display and a load selector, and FIG. 10 is a sectional view taken along the line X—X in FIG. 9, particularly showing a section of the load selector.

Referring to those figures, a change lever 90 projecting outward is fixedly connected to a slit plate 92, which is rotatable about a fixing shaft 98.

The slit plate 92 has three slits 94 having different distances from the fixing shaft 98 or different opening positions. A sensor portion 96 including three pairs of light emitting diodes 100 and phototransistors 98 corresponding to the respective portions of the three slits 94 is contained in the load selector 88. The change lever 90 can be set to eight positions around the fixing shaft 97 and the wire (not shown) is connected to the slit plate 92 so that the wire 66 shown in FIG. 5 can be moved according to the set position of the change lever 90. A light receiving pattern of the three phototransistors 98 for the light emitted from the three light emitting diodes 100 changes through the three different slits 94 dependent on the set position of the change lever 90. Accordingly, detection of the light receiving pattern of the phototransistors 98 makes it possible to determine the set position of the change lever 90, that is, to determine how a slope gradient is set by simulation of climbing resistance.

Figure 11:
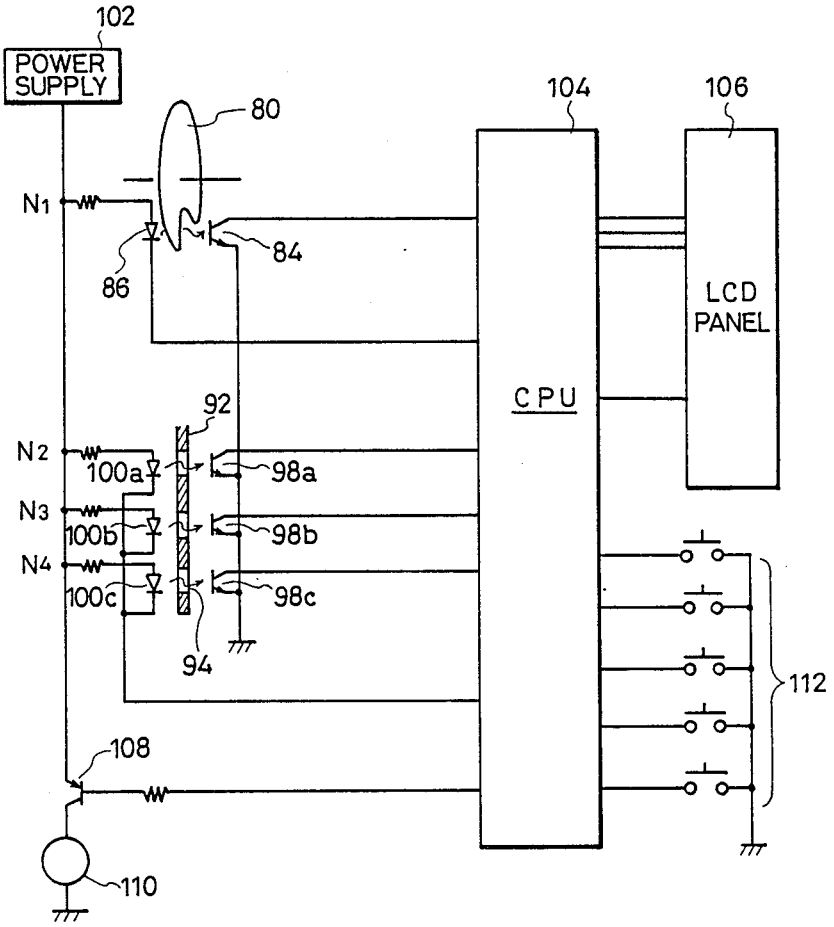
FIG. 11 is a schematic block diagram showing an electric construction of a cycle trainer according to an embodiment of the invention.

FIG. 11 is a schematic block diagram showing an electric construction.

Referring to FIG. 11, a buzzer 110 is connected between a power supply 102 and a ground power supply through a transistor 108 and the transistor 108 has its base connected to a CPU 104 through a resistor. Various set data, operation programs and the like are stored in the CPU 104 so that various arithmetic operations can be performed or various outputs can be provided according to the loading conditions of the load applying device. The buzzer 110 emits sound by conducting the transistor 108 in response to an output signal provided from the CPU 104 during various operations or at the end of a set period so that attention is given to the user. The light emitting diode 86 is connected to a node N1 and the CPU 104 through resistors, and the phototransistor 84 opposed to the light emitting diode 86 with the slit disc 80 being placed therebetween is connected between the CPU 104 and the ground power supply. Light emitting diodes 100*a* to 100*c* are connected between nodes N2 to N4 and the CPU 104, respectively, through resistors, and phototransistors 98*a* to 98*c* opposed to the light emitting diodes 100to 100*c* with the slit plated 92 having the slits 94 being placed therebetween are connected between the CPU 104 and the ground power supply. The CPU 104 is connected with an LCD panel 106 for displaying training setting conditions, elapsed time or the like, and a button switch group 112 for entering various set data referring to the display on the LCD panel 106.

In the present embodiment, the power supply 102, the buzzer 110, the CPU 104, the LCD panel 106 and the button switch group 112 as described above are all incorporated in the display device 9.

Figure 12:
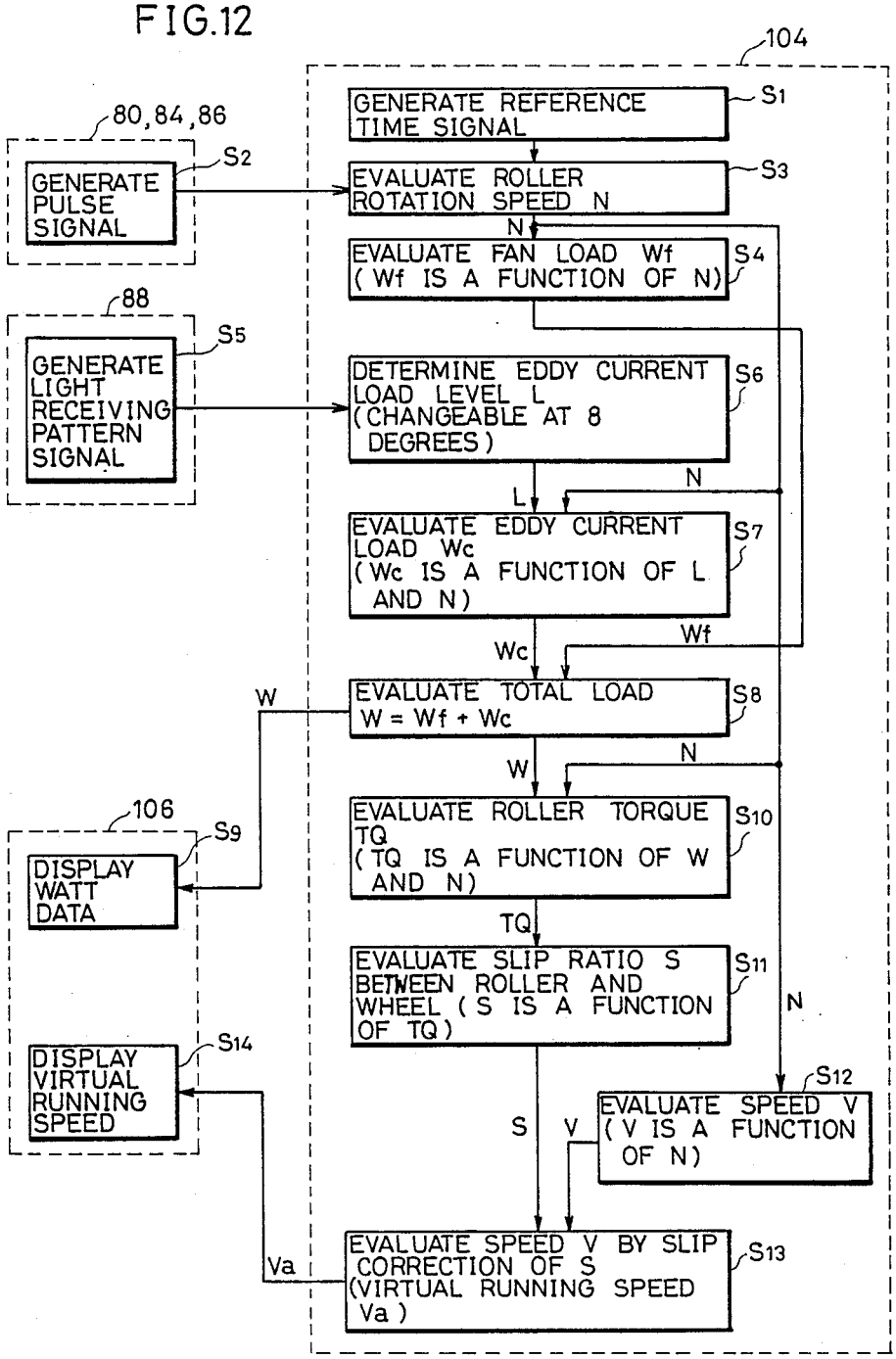
FIG. 12 is a schematic flow chart showing various processing operations of the cycle trainer according to the embodiment of the invention.

FIG. 12 is a schematic flow chart showing various processing operations based on the construction of FIG. 11.

The processing operations will be described with reference to FIG. 12.

First, when a specified switch of the button switch group 112 is turned on at the time of using the trainer, data are initialized and a reference time signal is generated (step S1). Then, training is started. The rotation speed N of the roller is evaluated (step S3) based on a pulse signal generated by the pulse generator 78 (step S2) and power Wf in opposition to load under pressure of the roller and load applied by the fan 50 is evaluated based on the rotation speed N (step S4). On the other hand, a signal based on the light receiving pattern of the three phototransistors 98 is generated in the load selector 88 (step S5) and an eddy current load level L is determined (step S6). Power Wc in opposition to an eddy current load is evaluated based on the rotation speed N of the roller and the eddy current load level L (step S7) and power W in opposition to total load is evaluated based on the power Wc and the previously evaluated power Wf (step S8). This power W is displayed as watt data on the LCD panel 106 of the display device 9 (step S9). Further, torque TQ of the roller is evaluated based on the roller rotation speed N and the total power W (step S10) and a slip radio S caused between the roller and the rear wheel tire is evaluated based on the torque TQ (step S11). On the other hand, a circumferential speed V of the roller is evaluated based on the roller rotation speed N (step S12) and a virtual riding speed Va taking account of slip is evaluated by correction of the slip radio S (step S13), whereby the virtual riding speed Va is displayed on the LCD panel 106 (step S14).

Consequently, the user can practice cycle training indoors, accurately simulating real riding, by referring to the watt data and the virtual riding speed displayed on the LCD panel.

Although the energizing force of the roller pressed by the tire is generated by the coil spring in the above described embodiment, it goes without saying that other means may be used to generate the energizing force insofar as it satisfies a given value.

In addition, although wind generated by the fan is not specifically utilized in the above described embodiment, it may be useful to direct the wind to the user as in the prior art in simulating real riding.

Further, although the clamp is disengaged at a position of contact between the roller and the tire as the position for energizing the roller to the rear wheel tire, it goes without saying that the clamp may be disengaged at other position insofar as the roller and the tire are in a fixed positional relation and the elastic force of the coil spring can be made to correspond to it.

As described in the foregoing, according to the present invention, a constantly accurate contact force between the drive wheel and the roller can be ensured and accordingly it is easy to apply an accurate load for simulating real riding. Thus, a cycle trainer with a high precision of simulation can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cycle trainer which rotatably supports a drive wheel (10) of a bicycle, constructed and arranged to be manually driven by said drive wheel through bicycle pedal movement, the cycle trainer comprising:

a rotatable roller (26), energizing means (24, 28, 30, 31, 32, 34) for energizing said roller at a constant level of force toward a direction of said drive wheel to be in contact therewith, movement blocking means (37, 38, 40) to be engaged with said energizing means, for blocking movement of said roller toward the direction of said drive wheel, position adjusting means (2, 3, 4, 22, 46) for adjusting said roller to a predetermined position with respect to said drive wheel, while the movement of said roller is blocked by said movement blocking means, disengaging means (38) for disengaging said movement blocking means from said energizing means, said disengaging means being operable to release said movement blocking means from said energizing means, causing said roller to be rotatably in contact with said drive wheel, said energizing means comprising:

a roller shaft (24) inserted in said roller and used integrally therewith as a unitary body, a pair of support frames for rotatably supporting said roller shaft, a fixing shaft (28) attached to penetrate said pair of support frames, a fixing plate (32) to which said fixing shaft is attached, a transverse plate (31) provided on said pair of support frames, a coil spring placed between said fixing plate and said transverse plate, and said pair of support frames being rotatable about said fixing shaft.

2. A cycle trainer in accordance with claim 1, wherein said movement blocking means comprises:

an engaging portion (37) attached to said transverse plate, a hook-shaped clamp (38) to be engaged with said engaging portion so that said coil spring is compressed by means of said transverse plate, and a clamp shaft (40) attached to said fixing plate, said hook-shaped clamp at a position in which said engaging portion is rotatable about said clamp shaft, while said coil spring is engaging said transverse plate.

3. A cycle trainer in accordance with claim 1, wherein said position adjusting means comprises:

a support body (3, 4) for rotatably supporting said drive wheel, a bar (2) connected to said fixing plate and able to be inserted in a position (22) of said support body, and a set screw portion (46) for blocking movement of said bar with respect to said support body with said bar being inserted in said support body.

4. A cycle trainer in accordance with claim, 1, wherein power of pedal movement in opposition to a rotation resistance applied to said drive wheel through said roller by energizing force of said energizing means is equal to power of pedal movement in opposition to a rolling resistance of a wheel in real, riding of a bicycle.

5. A cycle trainer in accordance with claim 4, further comprising:

a first load applying device (50) corresponding to air resistance in real riding and a second load applying device (52, 56, 90) corresponding to a gradient of a road at the time of real riding, said first load applying device being a fan fixed to one end of said roller shaft and rotating together with said roller shaft, power of pedal movement in opposition to rotation resistance applied to said drive wheel through said roller and said roller shaft arranged to be equal to power of pedal movement in opposition to the air resistance in real riding of a bicycle, by causing air resistance of said fan to be equal to air resistance in real riding of a bicycle, said second load applying device including a disc-shaped conductor (52) fixed to the other end of said roller shaft and rotating together with said roller shaft, a magnet (56) located to face opposite surfaces of said conductor to provide braking torque for applying brake to rotation of said conductor, and a magnetic flux controller (90) for controlling said braking torque by changing an amount of said magnetic flux, and power of pedal movement in opposition to rotation resistance applied to said drive wheel through said roller shaft and said roller, due to said braking torque, being equal to power of pedal movement in opposition to a climbing resistance in real riding of a bicycle on a slope.

6. A cycle trainer in accordance with claim 5, further comprising a pulse generator (78) for generating a pulse signal of a frequency proportional to the rotation speed of said roller, wherein a torque value applied to said roller is evaluated based on the cumulative power in opposition to said rolling resistance, said air resistance and said climbing resistance in real riding caused by the rotation of said roller in response to the pulse signal from said pulse generator, a slip ratio on a surface of contact between said drive wheel and said roller is corrected by said evaluated torque value, and a riding speed evaluated based on the rotation speed of said drive wheel is displayed.

* * * * *